United States Patent [19]

Rankel et al.

[11] Patent Number: 4,917,788

[45] Date of Patent: Apr. 17, 1990

[54] MANUFACTURE OF LUBE BASE STOCKS

[75] Inventors: Lillian A. Rankel, Princeton; Darrell D. Whitehurst, Titusville, both of N.J.

[73] Assignee: Mobil Oil Corporation, New York, N.Y.

[21] Appl. No.: 269,345

[22] Filed: Nov. 10, 1988

Related U.S. Application Data

[63] Continuation-in-part of Ser. No. 48,864, Jul. 12, 1987, abandoned.

[51] Int. Cl.[4] ..... C10G 53/04; C10G 55/04; C10G 57/00

[52] U.S. Cl. ..... 208/73; 208/18; 208/67; 208/85; 208/86; 208/87; 208/88; 208/106; 208/107; 208/120

[58] Field of Search ..... 208/46, 49, 18, 33, 208/85, 87, 86, 67, 120, 111, 106, 107, 88, 73

[56] References Cited

U.S. PATENT DOCUMENTS

| | | | |
|---|---|---|---|
| 2,895,902 | 7/1959 | Peet | 208/88 |
| 3,303,126 | 2/1967 | Gleim | 208/251 |
| 3,779,896 | 12/1973 | Woodle | 208/86 |
| 3,796,653 | 3/1974 | Gatsis | 208/95 |
| 4,138,227 | 2/1979 | Wilson et al. | 208/67 |
| 4,181,598 | 1/1980 | Gillespie et al. | 208/86 |
| 4,357,232 | 11/1982 | Holland et al. | 208/18 |
| 4,358,363 | 11/1982 | Smith | 208/91 |
| 4,361,477 | 11/1982 | Miller | 208/67 |
| 4,390,410 | 6/1983 | Audeh | 208/67 |
| 4,437,975 | 3/1984 | Gillespie | 208/97 |
| 4,446,007 | 5/1984 | Smith | 208/111 |
| 4,448,673 | 5/1984 | Shihabi | 585/739 |
| 4,490,242 | 12/1984 | Oleck et al. | 208/97 |
| 4,593,135 | 6/1986 | Gregory | 502/64 |
| 4,599,162 | 7/1986 | Yen | 208/111 |
| 4,678,556 | 7/1987 | Hicks et al. | 208/87 |

OTHER PUBLICATIONS

G. Rahbe et al., "Non-Catalytic Hydrodemetallization of Boscan Crude", J. Jaxan Petrol. Inst., 21, (2), 101-109 (1978).

*Primary Examiner*—Anthony McFarlane
*Attorney, Agent, or Firm*—Alexander J. McKillop; Charles J. Speciale; Malcolm D. Keen

[57] ABSTRACT

This invention provides a method for extending the catalytic dewaxing cycle time of a refined waxy lube stock. The method, in its broadest aspect, requires the additional refining step of thermally treating the refined waxy stock or precursor thereof for about 0.1 to about 2.0 hours at elevated temperature and at a pressure of 0 to 3000 psig (pounds per square inch gauge), and recovering an upgraded waxy stock having a reduced content of trace compounds that contain metals, nitrogen, sulfur and oxygen.

In a specific embodiment of this invention, a vacuum residuum is thermally treated at a temperature of about 700° F. to 950° F. prior to solvent deasphalting and solvent extraction, and the waxy bright stock so formed is catalytically dewaxed with extended cycle time.

22 Claims, No Drawings

MANUFACTURE OF LUBE BASE STOCKS

This application is a continuation-in-part of application Ser. No. 048,864, filed May 12, 1987 now abandoned.

FIELD OF THE INVENTION

This invention is broadly concerned with the manufacture of lubricating oils. In particular, it is concerned with extending the cycle life of the dewaxing catalyst in a refining process that includes catalytic dewaxing.

BACKGROUND OF THE INVENTION

Refining suitable petroleum crude oils to obtain a variety of lubricating oils which function effectively in diverse environments has become a highly developed and complex art. Although the broad principles involved in refining are qualitatively understood, there are quantitative uncertainties which require considerable resort to empiricism in practical refining. Underlying these quantitative uncertainties is the complexity of the molecular constitution of the precursor crude fractions. Because these crude fractions boil above about 550° F., the molecular weight of the constituents is high and these constituents display almost all conceivable structures and structure types including molecules that contain, in addition to carbon and hydrogen, metals, nitrogen, oxygen and sulfur, collectively referred to hereinbelow simply as "heteroatoms". This complexity and its consequences are referred to in "Petroleum Refinery Engineering", by W. L. Nelson, McGraw Hill Book Company, Inc., New York, N.Y. 1958 (Fourth Edition), relevant portions of this text being incorporated herein by reference for background.

The basic notion in lubricant refining is that a suitable crude oil, as shown by experience or by assay, contains a quantity of lubricant base stock having a predetermined set of properties such as, for example, appropriate viscosity, oxidation stability, and maintenance of fluidity at low temperatures. The process of refining to isolate that lubricant base stock currently consists of a set of subtractive unit operations which removes the unwanted components. The most important of these unit operations include distillation, solvent refining, and dewaxing, which basically are physical separation processes in the sense that if all the separated fractions were recombined one would reconstitute the crude oil.

A lubricant base stock (i.e. a refined oil) may be used as such as a lubricant, or it may be blended with another lubricant base stock having somewhat different properties. Or, the base stock, prior to use as a lubricant, may be compounded with one or more additives which function, for example, as antioxidants, extreme pressure additives, and V.I. improvers. As used herein, the term "stock" regardless whether or not the term is further qualified, will refer only to a hydrocarbon oil without additives. The term "raw stock" will be used herein to refer to an untreated viscous distillate or to the residuum isolated by vacuum distilling an atomospheric tower residuum of a petroleum crude, or its equivalent. The term "solvent-refined stock" or "raffinate" will refer to an oil that has been solvent extracted, for example with furfural. The term "dewaxed stock" will refer to an oil which has been treated by any method to remove or otherwise convert the wax contained therein and thereby reduce its pour point. The term "waxy", as used herein, will refer to an oil of sufficient wax content to result in a pour point greater than +25° F. The term "stock", when unqualified, will be used herein generically to refer to the viscous fraction in any stage of refining, but in all cases free of additives. The term "base stock", or "lube base stock", will refer to an oil refined to a point suitable for some particular end use, such as for preparing automotive oils.

Briefly, for the preparation of lube base stocks, the general practice is to vacuum distill an atmospheric tower residuum from an appropriate crude oil as the first step. This step provides one or more raw stocks within the boiling range of about 550° to 1050° F. and a vacuum residuum. After preparation, each raw stock is extracted with a solvent, e.g. furfural, phenol or chlorex, which is selective for aromatic hydrocarbons, and which removes undesirable components. The vacuum residuum usually requires an additional step to remove asphaltic material prior to solvent extraction. The raffinate from solvent refining is then dewaxed by admixing with a solvent such as a blend of methyl ethyl ketone and toluene, for example. The mixture is chilled to induce crystallization of the waxes which are then separated from the dewaxed dissolved raffinate in quantity sufficient to provide the desired pour point for the subsequently recovered dewaxed raffinate.

In general, refineries do not manufacture a single lube base stock but rather process at least one distillate fraction and the vacuum residuum. For example, three distillate fractions differing in boiling range and the residuum may be refined. These four fractions have acquired various names in the refining art, the most volatile distillate fraction often being referred to as the "light neutral" fraction or oil. The other distillates are called "intermediate neutral" and "heavy neutral" oils. The vacuum residuum, after deasphalting, solvent extraction and dewaxing, is commonly referred to as "bright stock".

Viscosity Index (V.I) is a quality parameter of considerable importance for lubricating oils to be used in automotive engines and aircraft engines which are subject to wide variations in temperature. This index is a series of numbers ranging from 0 to 100 which indicate the rate of change of viscosity with temperature. A Viscosity Index of 100 indicates an oil that does not tend to become viscous at low temperature or become thin at high temperatures. Measurement of the Saybolt Universal Viscosity of an oil at 100° and 210° F., and referral to correlations, provides a measure of the V.I. of the oil. For purposes of the present invention, whenever V.I. is referred to it is meant the V.I. as noted in the Viscosity Index tabulations of the ASTM(D567), published by ASTM, 1916 Race St., Philadelphia Pa., or equivalent.

To prepare high V.I. automotive and aircraft oils the refiner usually selects a crude oil relatively rich in paraffinic hydrocarbons, such oils being referred to commonly as "paraffin base" or "mixed base" crudes, since experience has shown that crudes poor in paraffins, such as those commonly termed "naphthene-base" crudes, yield little or no refined stock having a V.I. above about 40. (See Nelson, supra, pages 80–81 for classifications of crude oils). Suitable stocks for high V.I. oils, however, also contain substantial quantities of waxes which result in solvent-refined lubricating oil stocks of high pour point, i.e. a pour point greater than +25° F. Thus, in general, the refining of crude oil to prepare acceptable base stocks ordinarily includes dewaxing to reduce the pour point to a target value less than +25° F.

Raw distillate lubricating oil stocks usually do not have a particularly high V.I. However, solvent-refining, as with furfural, for example, in addition to removing unstable and sludge-forming components from the crude distillate, also removes components which adversely affect the V.I. Thus, a solvent-refined stock prior to dewaxing usually has a V.I. well in excess of specifications. Dewaxing, on the other hand, removes paraffins which have a V.I. of about 200, and thus reduces the V.I. of the waxy stock.

In recent years catalytic techniques have become available for dewaxing petroleum stocks. A process of that nature developed by British Petroleum is described in The Oil and Gas Journal dated Jan. 6, 1975, at pages 69–73. See also U.S. Pat. No. 3,668,113.

In U.S. Pat. No. Re. 28,398 to Chen et al. is described a process for catalytic dewaxing with a catalyst comprising Zeolite ZSM-5. Such processes combined with catalytic hydrofinishing is described in U.S. Pat. No. 3,894,938. U.S. Pat. No. 3,755,138 to Chen et al. describes a process for mild solvent dewaxing to remove high quality wax from a lube stock, which is then catalytically dewaxed to specification pour point. The entire contents of these patents are herein incorporated by reference.

The catalytic dewaxing process described in the foregoing Chen et al., for example, references is normally started at as low a temperature (start of run temperature) as will provide a product meeting the target pour point specification. The catalyst activity usually declines relatively fast during the first days on stream, as made evident by an increase in pour point of the dewaxed raffinate, and the decline in activity is compensated by gradually increasing the dewaxing temperature. After some days, a second period sets in, sometimes referred to as the "line-out period", during which catalyst activity declines very slowly and requires a compensatory small increase in temperature, for example, 1° F./day or less. When the temperature reaches a predetermined level (end of run temperature) above which the dewaxed product lacks stability prerequisites, the run is terminated to allow catalyst regeneration. The term "aging" will be used herein to refer to the catalyst deactivation which occurs either initially or during line-out operation. The term "catalyst cycle life" or "cycle life" as used herein means the length of time that elapses between the start of run temperature and the end of run temperature.

Catalyst aging in dewaxing is often ascribed to impurities in the waxy raffinate feed. While not wishing to be limited by theory, it seems reasonable to assume that certain of the organic compounds that have metals, nitrogen, oxygen or sulfur in their structure interact with and deactivate the acidic sites of the catalyst; and, that these and/or other impurities function as coke precursors which interact with the catalyst matrix to form deposits of carbonaceous catalyst residues. The CCR (Conradson Carbon Residue) of a stock is believed to be indicative of the propensity of a stock to form such catalyst residues. Also contributing to impurities in the waxy raffinate are the limitations of the solvent-refining process itself, which, due to the high viscosity and high molecular weight of lube stocks, diminish the efficiency of the solvent extraction and deasphalting steps.

A number of waxy raffinates from different crudes that can be dewaxed by the solvent process are not now efficiently dewaxed catalytically because of a prohibitively short cycle life. Also, waxy raffinates that are now or may be catalytically dewaxed would benefit from a slower rate of deactivation and extended cycle life.

BRIEF SUMMARY OF THE INVENTION

This invention provides a method for extending the cycle life of a catalyst used to dewax a refined waxy lube stock. The method, in its broadest aspect, comprises thermally treating a refined waxy stock or precursor thereof for about 0.1 to about 2.0 hours at about 450° F. to about 950° F. and a pressure of 0 to 3000 psig (pounds per square inch gauge), and recovering an upgraded waxy stock of reduced heteroatom content, all as more fully described hereinbelow.

In a specific embodiment of this invention, a vacuum residuum is thermally treated at a temperature of about 450° F. to 950° F. prior to solvent deasphalting and solvent extraction, and the waxy bright stock so formed is catalytically dewaxed with extended cycle time.

DETAILED DESCRIPTION, SPECIFIC EMBODIMENTS AND BEST MODE

We have now found that the organic heteroatom compounds contained in low or trace amounts in an atmospheric residuum are rendered advantageously labile at elevated temperatures. This finding provides the basis for a simple and effective thermal treatment which removes some of the impurities and/or coke precursors that limit the catalyst cycle time in catalytic dewaxing. The thermal treatment by itself generates some steam and/or ammonia and/or hydrogen sulfide, and one or more of the remaining heteroatom-type compounds are more effectively removed by the conventional solvent deasphalting and solvent extraction procedures used in lube manufacture.

The thermal treatment may be applied to a raw distillate or residuum stock, or it may be conducted on whole crude prior to atmospheric tower distillation, or on the atmospheric tower residuum prior to vacuum distillation, or on a lube stock at any stage of refining, including the waxy lube stock. There are a number of advantages to processing whole crude or reduced crude as the severity of operation can be higher and coking in furnace tubes is suppressed. In addition, having asphaltenes present during the thermal process enhances condensation reactions of distillate material containing heteroatoms and enhances removal during deasphalting and solvent refining.

The severity is of course limited by the specifications for the final lube product. Too high a severity lowers the viscosity and molecular weight of the final lube, but too low a severity will not enhance the selectivity in the solvent refining steps. Thus, there is an optimum in the thermal process severity that must be identified for each feedstock, because different crudes respond differently. The optimum may be found through simple scoping tests to determine the yield structure of the products as a function of their heteroatom concentration. Such scoping tests do not require undue experimentation. A loss of more than about 25% of the lube fraction to products boiling below 550° F. generally is not desirable.

When the reaction is conducted in the presence of an inert gas, such as helium or nitrogen gas, or with hydrogen gas, useful reaction temperatures are in the range of 700° to 950° F. with contact times of about 5 minutes to 2 hours but the preferred range is 800° to 900° F. with contact times of 10 to 60 minutes. The thermal process can be conducted in a continuous flow or batch mode, and at atmospheric or elevated pressures. Generally, elevated pressures are preferred in the presence of an inert gas or hydrogen gas. Hydrogen pressures of 200 to 3000 psig are useful with a preferred range of 400 to 1500 psig. Addition of condensation reactions of heteroatom-containing materials.

The thermal treatment may also be conducted in the presence of gaseous oxygen, such as with air. Oxygen promotes conversion of heteroatom-containing molecules to forms which are more easily removed by solvent extraction. In the presence of gaseous oxygen, the process is conducted at temperatures of about 450° F. to 700° F. and at atmospheric pressure so as not to excessively oxidize the rest of the feed.

Solvent extractions following the thermal process are conventional.

The catalytic dewaxing process per se is not a part of the present invention. Although it is contemplated to use the improved process of this invention with any catalytic dewaxing process wherein the catalyst normally requires fairly frequent regeneration, it is particularly well suited to the dewaxing process wherein the catalyst comprises a zeolite having the structure of ZSM-5 or ZSM-11. ZSM-5 is described and claimed in U.S. Pat. No. 3,702,886, the entire content of which is incorporated herein by reference. ZSM-11 is described and claimed in U.S. Pat. No. 3,709,979, the entire content of which is incorporated herein by reference.

The following examples are intended to illustrate this invention without delimiting the scope thereof, which scope is determined by this entire specification and appended claims.

EXAMPLES 1–4

In these examples, an Arab Light 1075° F.+ vacuum residuum was used. Analysis showed 84.3 wt % carton, 10.3 wt % hydrogen, 0.82 wt % nitrogen, 0.41 wt % oxygen and 4.26 wt % sulfur, and a CCR (Conradson Carbon Residue) of 19 wt %. It also contained 24 ppm of Nickel and 88 ppm of Vanadium.

Example 1 shows, for comparison purpose, the results of propane deasphalting with no thermal treatment.

In Examples 2, 3 and 4 thermal treatment was conducted at different contact times and at 850° F., in the presence of an inert gas, Helium, at 500 psig pressure. The treatment was followed by propane deasphalting. The reactor used for the thermal treatment was a coiled stainless steel ¼ in. tube packed with 16/20 vycor and heated in a fluidized bath. The oil was pumped through a 6 in. tube preheater (heated to 500° F. and ¼ in. in diameter) into the reactor. A fresh stainless steel reactor was used for each run. Space velocities ranging from 0.3 to 5.5 were investigated. Run temperature was 850° F. Material balances were 90% or greater and results were normalized to a no loss basis.

In order to propane deasphalt the oils on a laboratory scale, they were first pentane deasphalted to make the residuum more tractable, and then propane deasphalted at room temperature in Altex glass chromatography columns (42 ml volume rated at 500 psig). The pentane deasphalted sample was put into the tared glass column and a sample weight was obtained. The propane was added by volume to the volume-marked column. A 10:1 propane/oil ratio was used. The column was agitated by inverting to mix the oil and solvent. Mixing was done 3 to 4 times with settling in between. The hydrocarbon soluble oil was decanted through the valve at the top of the column into a tarred container where the light hydrocarbon evaporated off. The insoluble part of the oil remained in the column and was washed out with pentane. The pentane in the propane insoluble oil was removed in a vacuum oven.

TABLE I

| Example No. | LHSV, Hrs-1 | Deasphalted Oil: Thermal Treatment, 850° F., 500 psig He gas % DM | Wt % N | Wt % O | Wt % S | CCR Wt % | CCR % Decrease | ppm Ni | ppm V |
|---|---|---|---|---|---|---|---|---|---|
| 1 | None | 94 | 0.14 | <.3 | 2.95 | 4.99 | 74 | 2 | 5 |
| 2 | 7.5 | 97 | 0.11 | 0.45 | 2.77 | 3.15 | 83 | 2 | 1 |
| 3 | 5.0 | 98+ | 0.2 | 0.36 | 2.73 | 2.83 | 85 | <1 | <1 |
| 4 | 2.0 | 98 | 0.1 | <.3 | 2.75 | 2.62 | 86 | 1 | 1.6 |
| | | | | (Asphaltenes Composition) | | | | | |
| 1 | None | — | 0.45 | 1.13 | 5.26 | — | — | — | — |
| 3 | — | — | 0.72 | 0.47 | 5.84 | — | — | — | — |

EXAMPLES 5–8

In these examples an Arab Heavy 1050° F.+ resid was used. Since the resid had a pour point of 135° F., it was necessary to maintain the pump, reservoir and lines at about this temperature. No thermal treatment was used in Example 5. Examples 6–8 were thermally treated as in Example 2 but at a reactor temperature of 750° F., a LHSV of 0.3, and at 500 psig pressure. The product was deasphalted with heptane followed by pentane, rather than with propane as in Example 2. Example 6 was conducted with hydrogen gas circulation at 2000 SCF/Bbl, and Example 7 with hydrogen gas to which 20 mol % hydrogen sulfide was added.

The results are summarized in Table II. The raw resid analyzed 60 ppm Ni, 160 ppm V, 0.43 wt % N, 5.24 wt % S, and 21.0 wt % CCR.

TABLE II

| Example No. | Gas | Arab Heavy, 1050+, pentane-deasphalted oil. Press, psig | Temp., °F. | LHSV | Ni ppm | V ppm | CCR % | CCR % Red'n |
|---|---|---|---|---|---|---|---|---|
| 5 | Control | — | — | — | 12 | 35 | 11.3 | 46 |
| 6 | $H_2$ | 500 | 750 | 0.3 | 8.0 | 21.6 | 10* | 52 |
| 7 | $H_2 + H_2S$ | 500 | 750 | 0.3 | 8.4 | 22.9 | 10* | 52 |
| 8 | $H_2$ | 1000 | 850 | 1.0 | 3.2 | 8.4 | 6.8 | 68 |

*Estimated

EXAMPLE 9

A portion of the same Arab Light resid as used in Example 1 was contacted with air at 617° F. with a contact time of about 5 minutes in a thin film reactor, followed by the same propane deasphalting step as used in Example 1. This procedure achieved more than 97% demetallation. The asphaltenes contained 0.460 wt % nitrogen, 0.93 wt % oxygen, and 5.48 wt % S. The CCR of the recovered oil was 4.44 wt % compared with 4.99 for Example 1.

EXAMPLE 10

The products formed in above Examples 1 and 3 are furfural extracted and are subjected to catalytic dewaxing to a target pour point of 15° F. using a ZSM-5 dewaxing catalyst. The cycle life with the waxy bright stock of Example 3 is longer than with the bright stock of Example 1.

What is claimed is:

1. In a process for manufacturing a lube bright stock, said process comprising deasphalting a vacuum resid, solvent extracting said deasphalted resid, and catalytically dewaxing said deasphalted, solvent-extracted resid, the improvement whereby the cycle life of the dewaxing catalyst is extended by thermally treating said vacuum resid for about 0.1 to about 2.0 hours at a temperature of about 450° F. to about 950° F. and at a pressure of 0 to 3000 psig prior to said deasphalting step.

2. The process described in claim 1 wherein said thermal treatment is conducted in the presence of an inert gas and said temperature is about 700° to 950° F.

3. The process described in claim 1, wherein said thermal treatment is conducted in the presence of hydrogen gas, said temperature is about 700° to 950° F. and said pressure is about 400 to 1500 psig.

4. The process described in claim 1 wherein said thermal treatment is conducted in the presence of air at atmospheric pressure and said temperature is about 450° F. to 700° F.

5. The process described in claim 1 wherein said dewaxing catalyst comprises a zeolite having the crystal structure of ZSM-5 or ZSM-11.

6. The process described in claim 2 wherein said dewaxing catalyst comprises zeolite having the crystal structure of ZSM-5 or ZSM-11.

7. The process described in claim 3 wherein said dewaxing catalyst comprises a zeolite having the crystal structure of ZSM-5 or ZSM-11.

8. The process described in claim 4 wherein said dewaxing catalyst comprises zeolite having the crystal structure of ZSM-5 or ZSM-11.

9. In a method for manufacturing a lube base stock by catalytically dewaxing a refined waxy stock, said refined waxy stock being prepared by solvent extraction of a precursor distillate stock or a deasphalted residuum wherein said deasphalted residuum is prepared from a precursor vacuum tower residuum, said distillate stock and vacuum tower residuum being in turn prepared from a precursor atmospheric tower residuum prepared from a crude oil, the improvement whereby the catalyst cycle time in said catalytic dewaxing step is extended by thermally treating a material selected from the group consisting of a refined waxy stock and the precursors thereof for about 0.1 to about 2.0 hours at about 450° F. to 900° F. and at a pressure of 0 to 3000 psig, and recovering an upgraded refined waxy stock.

10. The method described in claim 9 wherein said thermally treated material is an atmospheric tower residuum.

11. The method described in claim 9 wherein said thermally treated material is a vacuum resid.

12. The method described in claim 9 wherein said material is a deasphalted vacuum resid.

13. The method described in claim 9 wherein said material is a distillate stock.

14. The method described in claim 9 wherein said treatment is conducted in the presence of hydrogen or an inert gas at a temperature of about 700° to 950° F. and a pressure of about 400 to 1500 psig.

15. The method described in claim 10 wherein said treatment is conducted in the presence of hydrogen or an inert gas at a temperature of about 700° to 950° F. and a pressure of about 400 to 1500 psig.

16. The method described in claim 11 wherein said treatment is conducted in the presence of hydrogen or an inert gas at a temperature of about 700° to 950° F. and a pressure of about 400 to 1500 psig.

17. The method described in claim 12 wherein said treatment is conducted in the presence of hydrogen or an inert gas at a temperature of about 700° to 950° F. and a pressure of about 400 to 1500 psig.

18. The method described in claim 13 wherein said treatment is conducted in the presence of hydrogen or an inert gas at a temperature of about 700° to 950° F. and a pressure of about 400 to 1500 psig.

19. The method described in claim 9 wherein said thermally treated material is a crude oil.

20. The method described in claim 19 wherein said thermal treatment is conducted in the presence of air at about atmospheric pressure and said temperature is about 450° F. to 700° F.

21. The method described in claim 19 wherein said thermal treatment is conducted in the presence of hydrogen gas, said temperature is about 700° to 950° F. and said pressure is about 400 to 1500 psig.

22. The method described in claim 21 wherein said hydrogen gas contains 20 mol % of hydrogen sulfide.

* * * * *

UNITED STATES PATENT AND TRADEMARK OFFICE

CERTIFICATE OF CORRECTION

PATENT NO. : 4,917,788

DATED : April 17, 1990

INVENTOR(S) : Lillian A. Rankel et al

It is certified that error appears in the above-identified patent and that said Letters Patent is hereby corrected as shown below:

Column 5, line 7; after "Addition of", insert --small amounts of $H_2S$ to the hydrogen gas can further enhance the--

Column 5, line 50; "carton" should be --carbon--

Signed and Sealed this

Nineteenth Day of November, 1991

*Attest:*

HARRY F. MANBECK, JR.

*Attesting Officer*

*Commissioner of Patents and Trademarks*